US007815231B2

(12) United States Patent
Suzumura et al.

(10) Patent No.: US 7,815,231 B2
(45) Date of Patent: Oct. 19, 2010

(54) DOOR LOCK DEVICE FOR AUTOMOTIVE

(75) Inventors: Makoto Suzumura, Chita (JP); Akira Muramatsu, Chiryu (JP); Kazuhisa Hidaka, Toyota (JP); Kazutaka Kojima, Ichinomiya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 687 days.

(21) Appl. No.: 11/667,731

(22) PCT Filed: Nov. 16, 2005

(86) PCT No.: PCT/JP2005/021399

§ 371 (c)(1),
(2), (4) Date: May 15, 2007

(87) PCT Pub. No.: WO2006/054760

PCT Pub. Date: May 26, 2006

(65) Prior Publication Data

US 2008/0289373 A1 Nov. 27, 2008

(30) Foreign Application Priority Data

Nov. 17, 2004 (JP) ..... 2004-332631
Nov. 17, 2004 (JP) ..... 2004-332632

(51) Int. Cl.
*E05C 3/06* (2006.01)
*E05C 3/16* (2006.01)

(52) U.S. Cl. ..... 292/216; 292/201; 292/DIG. 53; 292/DIG. 54; 292/DIG. 64

(58) Field of Classification Search ..... 292/201, 292/216, DIG. 53, DIG. 54, DIG. 64
See application file for complete search history.

(56) References Cited

U.S. PATENT DOCUMENTS 5,492,379 A * 2/1996 Staser et al. ..... 292/336.3

(Continued)

FOREIGN PATENT DOCUMENTS

JP 1-42653 U 12/1989

(Continued)

OTHER PUBLICATIONS

Official Action and accompanying Search Report issued by the Taiwan Patent Office in Taiwan Patent Application No. 094140335, Nov. 23, 2009, 3 pages, IPO, TW; and English-language translation of Search Report (1 page).

(Continued)

*Primary Examiner*—Carlos Lugo
(74) *Attorney, Agent, or Firm*—Buchanan Ingersoll & Rooney PC

(57) ABSTRACT

This invention provides an automotive door lock device capable of securely preventing a dropout of an operation connecting portion of an operation device from an operating lever connecting portion of an operating lever member. The automotive door lock device includes a housing having a housing body including an opening portion and a cover portion formed integrally with the housing body for opening and closing the opening portion. An operating lever member is placed in the housing and has an operating lever connecting portion. The operation device has an operation connecting portion to be connected to the operating lever connecting portion. The cover portion of the housing has a projecting portion for preventing a dropout of the operation connecting portion of the operation device.

9 Claims, 9 Drawing Sheets

U.S. PATENT DOCUMENTS

| | | | | | |
|---|---|---|---|---|---|
| 5,520,426 | A * | 5/1996 | Arabia et al. | 292/337 |
| 5,845,947 | A * | 12/1998 | Arabia et al. | 292/1 |
| 5,934,817 | A * | 8/1999 | Kim et al. | 403/196 |
| 6,536,814 | B2 * | 3/2003 | Kachouh | 292/216 |
| 6,575,506 | B2 * | 6/2003 | Hayakawa et al. | 292/216 |
| 6,634,682 | B2 * | 10/2003 | Fukunaga et al. | 292/216 |
| 6,705,140 | B1 * | 3/2004 | Dimig et al. | 70/277 |
| 6,945,574 | B2 * | 9/2005 | Hayakawa et al. | 292/201 |
| 6,951,355 | B2 * | 10/2005 | Hayakawa et al. | 292/201 |
| 7,021,681 | B2 * | 4/2006 | Hayakawa et al. | 292/216 |
| 7,055,872 | B2 * | 6/2006 | Hayakawa et al. | 292/216 |
| 7,380,845 | B2 * | 6/2008 | Suzumura et al. | 292/216 |
| 7,559,586 | B2 * | 7/2009 | Fukunaga et al. | 292/216 |
| 7,637,542 | B2 * | 12/2009 | Suzumura et al. | 292/216 |
| 2003/0173786 | A1 | 9/2003 | Miyagawa et al. | |
| 2008/0048458 | A1 * | 2/2008 | Suzumura et al. | 292/216 |
| 2009/0212577 | A1 * | 8/2009 | Fukunaga et al. | 292/216 |

FOREIGN PATENT DOCUMENTS

| | | | |
|---|---|---|---|
| JP | 2-40118 | U | 3/1990 |
| JP | 6-50929 | U | 7/1994 |
| JP | 08-114052 | A | 5/1996 |
| JP | 2002-129813 | A | 5/2002 |
| JP | 2002129813 | A * | 5/2002 |
| JP | 2003-239598 | A | 8/2003 |
| JP | 2003-314117 | A | 11/2003 |
| TW | 422261 | | 2/2001 |
| TW | 572108 | | 1/2004 |

OTHER PUBLICATIONS

International Search Report for PCT/JP2005/021399 dated Jan. 24, 2006.

English translation of the International Preliminary Report on Patentability for PCT/JP2005/021399.

* cited by examiner

DOOR LOCK DEVICE FOR AUTOMOTIVE

TECHNICAL FIELD

The present invention relates to an automotive door lock device.

BACKGROUND ART

The device recited in Patent Document 1 is known as a conventional automotive door lock device. The automotive door lock device is provided with a resinous housing, and an opening is formed on the housing. An operating lever connecting portion of an operating lever is exposed through the opening of the housing, and the operating lever connecting portion is connected to an operation connecting portion provided on a locking cable which serves as an operation means. Here, a cover portion for opening and closing the opening of the housing is integrally formed with the housing.

In this type of automotive door lock device, the cover portion is precisely engaged with the opening of the housing and water penetration can be prevented. Moreover, since the cover portion is integrally formed with the housing, the number of component parts can be reduced, and so the device provides a construction which enables low-cost production.

(Patent Document 1: Japanese Unexamined Patent Publication (Kokai) No. 2002-129813)

DISCLOSURE OF THE INVENTION

Problems to be Solved by the Invention

However, it is difficult to say that the abovementioned automotive door lock device has a structure capable of preventing a dropout of the connecting portion of the operation means from the connecting member of the operating lever.

The present invention has been conceived in view of the abovementioned conventional circumstances, and it is an object of the present invention to provide an automotive door lock device capable of securely preventing a dropout of the connecting portion of the operation means from the connecting member of the operating lever. Furthermore, it is another object of the present invention, which has been found in view of the abovementioned conventional circumstances, to provide an automotive door lock device capable of easily connecting the connecting portion of the operation means with the connecting member of the operating lever.

Means for Solving the Problems

Technical means taken in the present invention for solving the above problems is characterized in that, in an automotive door lock device in which an operation connecting portion of operation means is to be connected to an operating lever connecting portion of an operating lever member placed in a resinous housing through an opening formed on the housing, a cover portion capable of opening and closing the opening of the housing is integrally formed with the housing, and an arc-shaped projecting portion for preventing a dropout of the operation connecting portion of the operation means is formed on the cover portion, and the projecting portion is located along an arc-shaped moving locus of the operation connecting portion. Namely, in an automotive door lock device comprising: a housing having a housing body including an opening portion, and a cover portion formed integrally with the housing body for opening and closing the opening portion; an operating lever member placed in the housing and having an operating lever connecting portion; and operation means having an operation connecting portion to be connected to the operating lever connecting portion, The automotive door lock device of the present invention is characterized in that the cover portion of the housing has am arc-shaped projecting portion for preventing a dropout of the operation connecting portion of the operation means, and the projecting portion is located along an arc-shaped moving locus of the operation connecting portion. In the automotive door lock device of the present invention, the operation connecting portion of the operation means connected to the operating lever connecting portion of the operating lever is inhibited from dropping off from the operating lever connecting portion by the projecting portion provided on the cover of the housing. Therefore, the dropout of the operating lever connecting portion and the operation connecting portion is inhibited, and the function of the door lock device is maintained properly.

It is preferable that this projecting portion prevents the dropout by inhibiting movement in a direction to separate from the operating lever connecting portion to which the operation connecting portion is connected.

Moreover, it is preferable that a convex portion capable of contacting the operating lever member is formed on the housing body, which constitutes a main part of the housing, at a position facing the projecting portion of the cover portion in a closed state. This convex portion can prevent the dropout by inhibiting movement in a direction to separate from the operation connecting portion to which the operating lever connecting portion is connected.

The operating lever member and the operation means which are connected to each other are located in a space formed between the housing body and the cover member, and furthermore the operating lever member and the operation means are to be located between the convex portion of the housing body and the projecting portion of the cover member. When the operating lever member and the operation means respectively move in directions to drop out, the operating lever member and the operation means bump against the convex portion of the housing body or the projecting portion of the cover member, so that their movements are inhibited and the dropout is inhibited. It is to be noted that the projecting portion and the convex portion contact the operating lever member and the operation means at their fore ends, so that the contact area is small. Therefore, even in contact with the projecting portion and the convex portion, the operating lever member and the operation means show little resistance to the contact, and the contact does not hinder smooth movements of the operating lever member and the operation means.

Either one of the operating lever connecting portion and the operation connecting portion can be constituted by a concave portion, and the other one of the operating lever connecting portion and the operation connecting portion can be a spherical portion to be attached and connected to the concave portion. It is preferable that the operating lever connecting portion is the concave portion and that the operation connecting portion is the spherical portion held slidably by this concave portion. Owing to a combination of the concave portion and the spherical portion to be attached to it, attachment becomes easy and the concave portion and the spherical portion can be rotated with respect to each other, thereby increasing the degree of relative movement freedom.

It is also preferable that a tapered surface is formed on an opening periphery of the concave portion so as to have an enlarged opening end shape. This makes the attachment of the spherical portion to the concave portion much easier. It is also preferable that a projection is formed inside the opening periphery of the concave portion. This projection inhibits the dropout of the attached spherical portion from the concave portion. It is possible to form a plurality of projections.

Moreover, an opening of the concave portion can face the opening portion of the housing body. An operation to attach the spherical portion into the concave portion through the opening of the opening portion becomes easy. It is to be noted that it is preferable that space sectioned by the concave portion is hemispherical. This makes the attachment easy and makes the relative rotation with respect to the spherical portion smooth.

Furthermore, it is preferable that the projecting portion is an arc-shaped convex ridge located along a moving locus of the operation connecting portion. It is preferable that the convex portion is also an arc-shaped convex ridge located along a moving locus of the operating lever member. Even if the operation connecting portion and the operating lever connecting portion are moved by an operation and their locations within the housing are changed, owing to these convex ridges the operation connecting portion and the operating lever connecting portion are always located between the projecting portion and the convex portion, and the lock device has a function of preventing separation of the operation connecting portion and the operating lever connecting portion by the projecting portion and the convex portion.

It is preferable that the housing body and the cover portion have distance keeping means for keeping the distance between the housing body and the cover portion constant when the cover portion is in a closed state. Owing to this distance keeping means, the relative positions of the housing body and the cover portion are kept constant more securely when the cover portion is in the closed state, and even if some large force for separation is applied on the operation connecting portion and the operating lever connecting portion and as a result a large force is applied to relatively separate the housing body and the cover portion by way of the projecting portion and the convex portion, the distance keeping means inhibits relative separating movements and accordingly inhibits the separation between the operation connecting portion and the operating lever connecting portion.

ADVANTAGES OF THE INVENTION

According to the present invention, after the operating lever connecting portion of the operating lever member and the operation connecting portion of the operation means are connected to each other, the opening of the housing can be closed by the cover portion formed integrally with the housing body. At this time, the projecting portion is formed on the cover portion, and the projecting portion prevents a dropout of the operation connecting portion of the operation means. Therefore, if the operation connecting portion of the operation means is connected to the operating lever connecting portion of the operating lever member placed in the housing and the cover portion closes the opening, the operation connecting portion of the operation means becomes difficult to drop off from the operating lever connecting portion of the operating lever member. Therefore, the connection between the operation connecting portion of the operation means and the operating lever connecting portion of the operating lever member can be secured only by closing the housing with the cover portion.

Therefore, in the automotive door lock device of the present invention, a dropout of the operation connecting portion of the operation means from the operating lever connecting portion of the operating lever member can be securely prevented.

Moreover, according to the present invention, since the convex portion is formed at the position facing the projecting portion of the cover portion in a closed state, the convex portion is located in the housing so as to face the projecting portion of the cover portion. Therefore, owing to the contact of the convex portion with the operating lever member, the convex portion and the projecting portion of the cover portion can sandwich the connection between the operating lever connecting portion of the operating lever member and the operation connecting portion of the operation means. Therefore, the dropout of the operation connecting portion of the operation means from the operating lever connecting portion of the operating lever member can be more securely prevented.

Moreover, according to the present invention, the operating lever connecting portion of the operating lever member has a concave shape and the operation connecting portion of the operation means has a spherical shape. Therefore, the operation connecting portion can be easily connected to the operating lever connecting portion. Moreover, since the operating lever connecting portion comes in slidable contact with the operation connecting portion, even when the operating lever connecting portion and the operation connecting portion move along an arc-shaped moving locus, their connection is hardly broken.

Therefore, in the automotive door lock device of the present invention, the operation connecting portion of the operation means can be easily connected to the operating lever connecting portion of the operating lever member.

Moreover, according to the present invention, since the tapered surface is formed on the opening periphery of the concave portion, the operation connecting portion can be easily connected to the operating lever connecting portion. Moreover, since a pair of projections is formed inside the opening periphery of the concave portion, if the operation connecting portion is connected to the operating lever connecting portion, the operation connecting portion can be difficult to drop off from the operating lever connecting portion.

BEST MODE FOR CARRYING OUT THE INVENTION

Hereinafter, best mode for carrying out the present invention will be described based on the drawings with reference to an embodiment.

Embodiment

Figure 1:
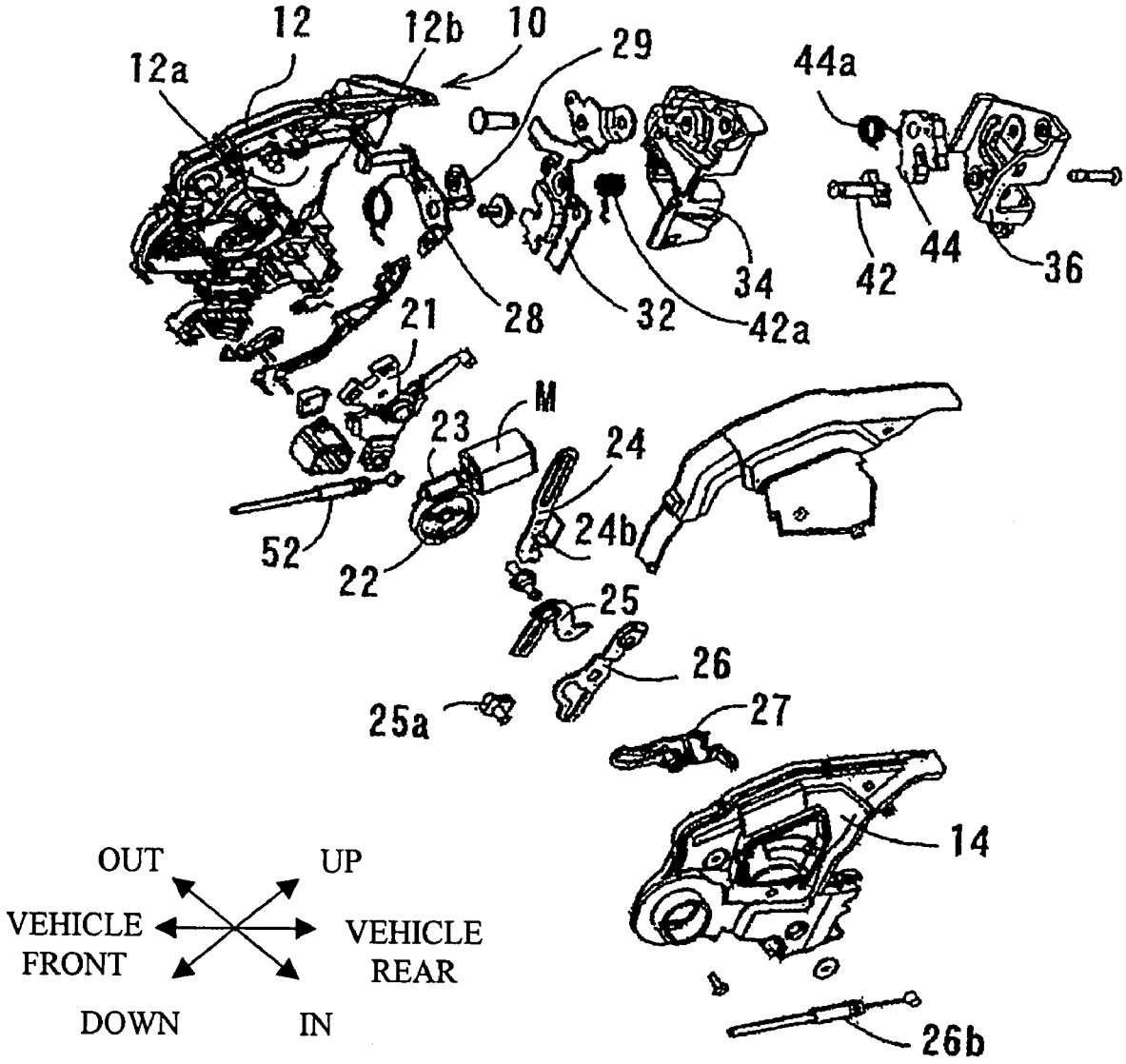
FIG. 1 is a perspective exploded view of an automotive door lock device according to an embodiment.
Figure 4:
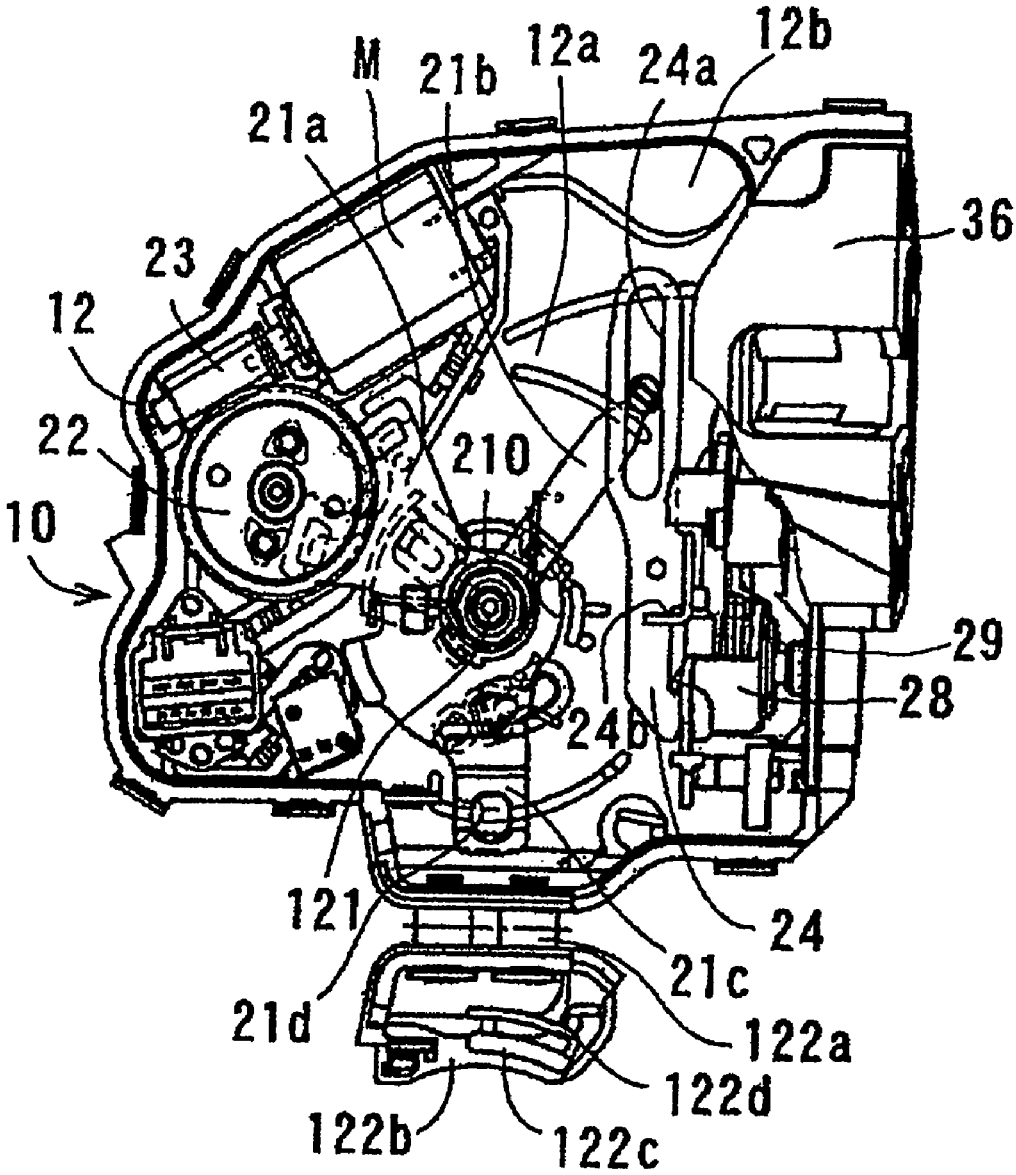
FIG. 4 is a partial front elevational view of the automotive door lock device according to the embodiment in an initial unlocked state.
Figure 4:
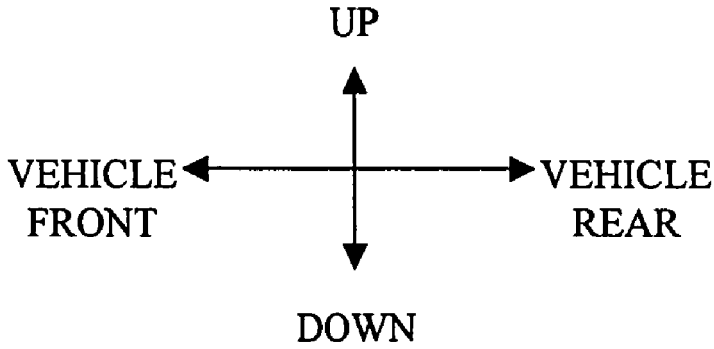
Figure 5:
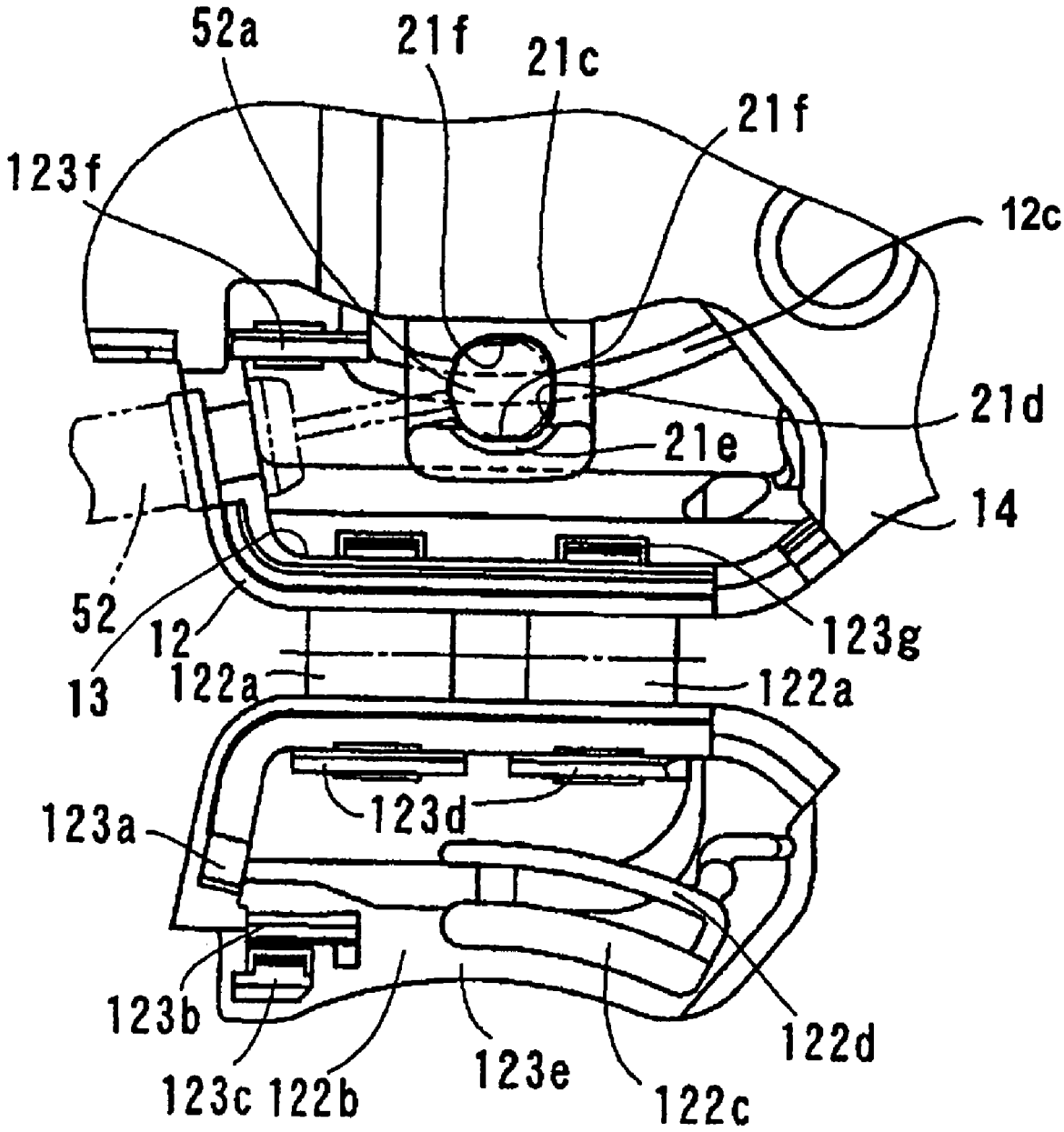
FIG. 5 is a partially enlarged view of the automotive door lock device according to the embodiment.

An embodiment of automotive door lock device is provided, as shown in FIGS. 1 and 5, with a main casing 12 and a first cover 14, as a resinous housing 10. As shown in FIG. 4, the main casing 12 includes a dish-shaped first casing portion 12*a* which opens inward, and a dish-shaped second casing portion 12*b* which adjoins the first casing portion 12*a* and opens inward. Moreover, as shown in FIG. 5, the inside of the main casing 12 is covered with the first cover 14.

Figure 6:
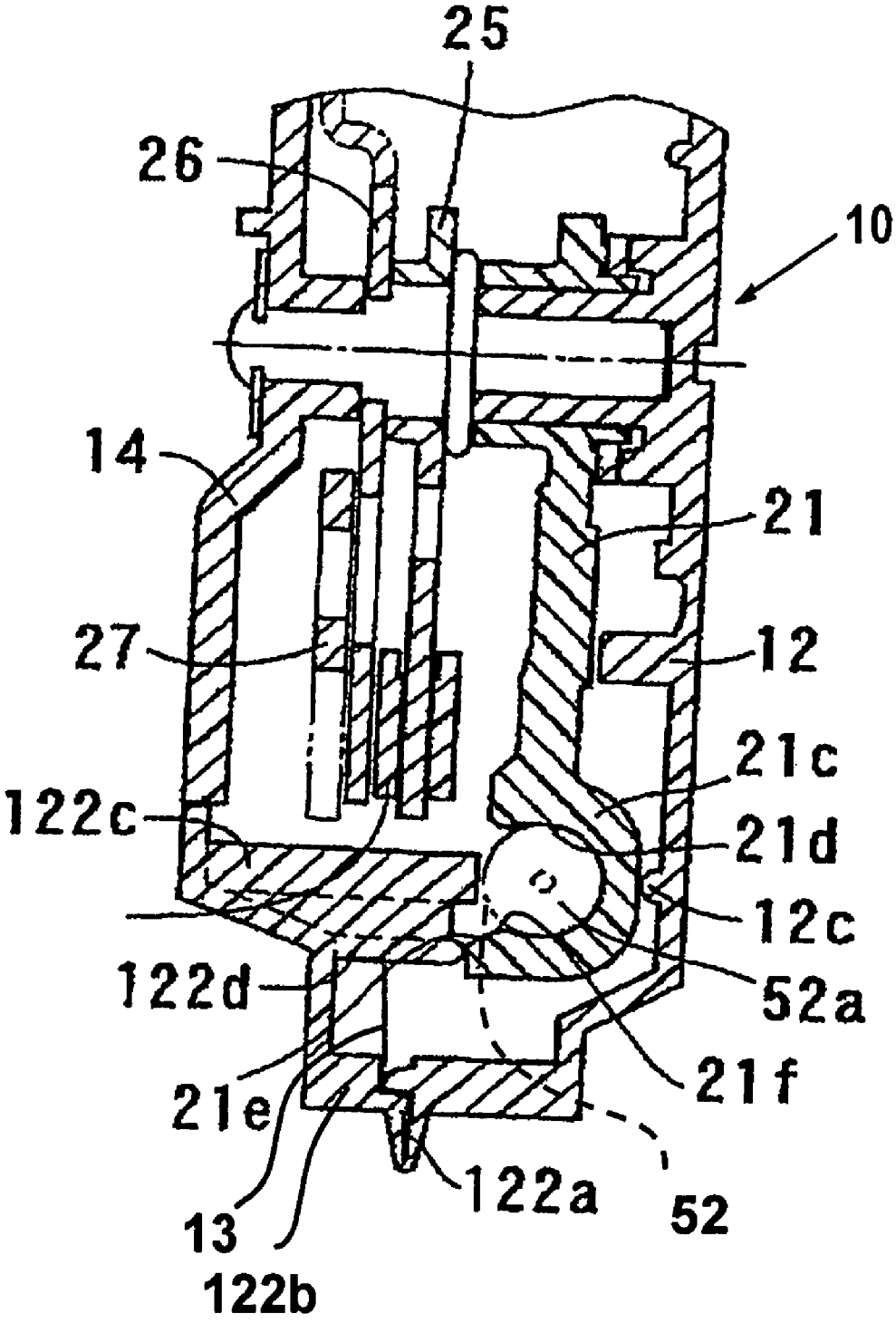
FIG. 6 is a partially enlarged sectional view of the automotive door lock device according to the embodiment.

Between the main casing 12 and the first cover 14, the door lock device is provided, as shown in FIG. 6, with a locking lever 21, a second inside lever 25, a first inside lever 26, a child protector 27, and as shown in FIG. 4, with a wheel gear 22, a motor M provided with a worm gear 23, an open link 24, an open lever 28 and a lift lever 29. It is to be noted that the locking lever 21 constitutes the operating lever member of the present invention.

Figure 2:
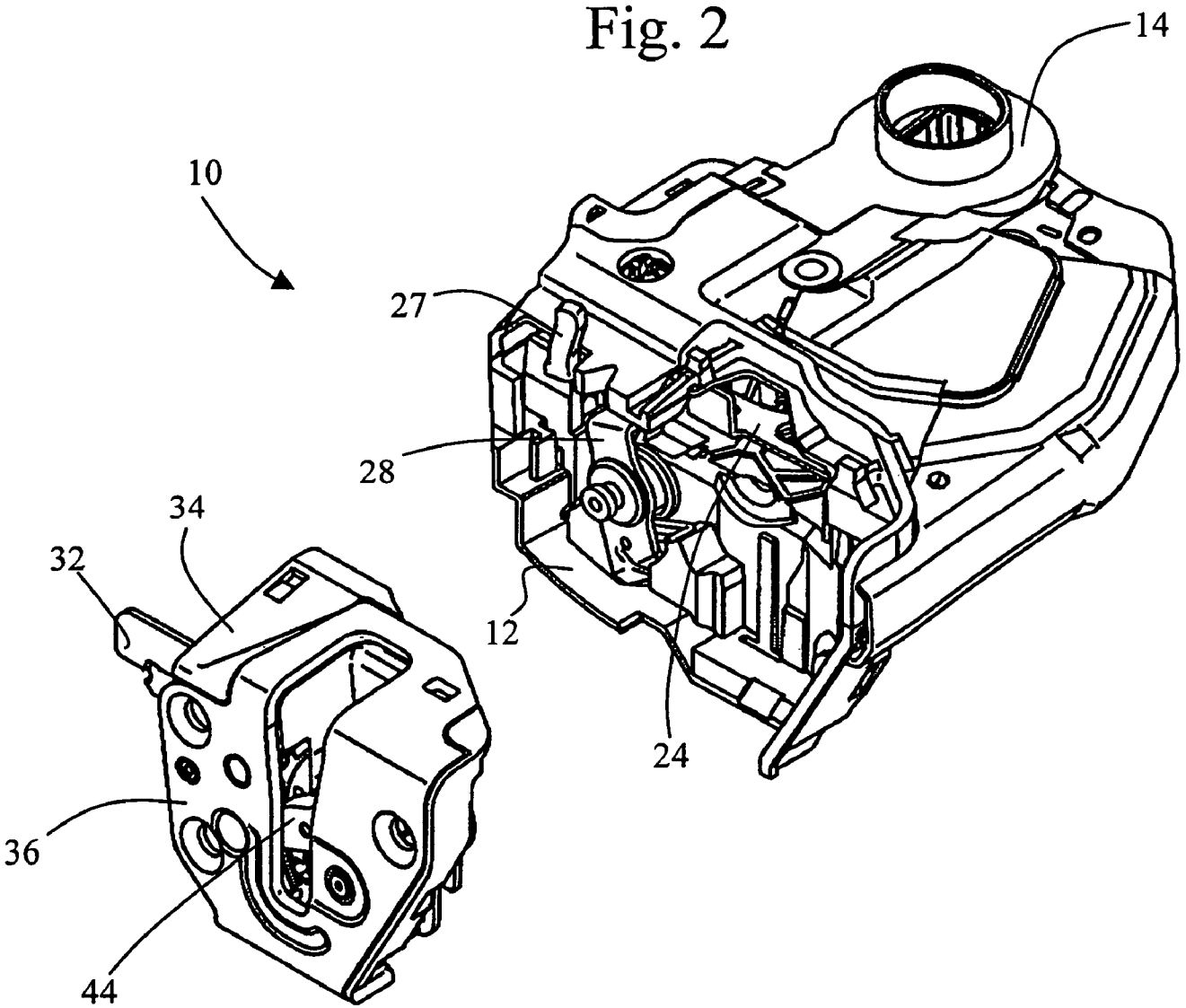
FIG. 2 is a perspective view of the entire automotive door lock device according to the embodiment.
Figure 3:
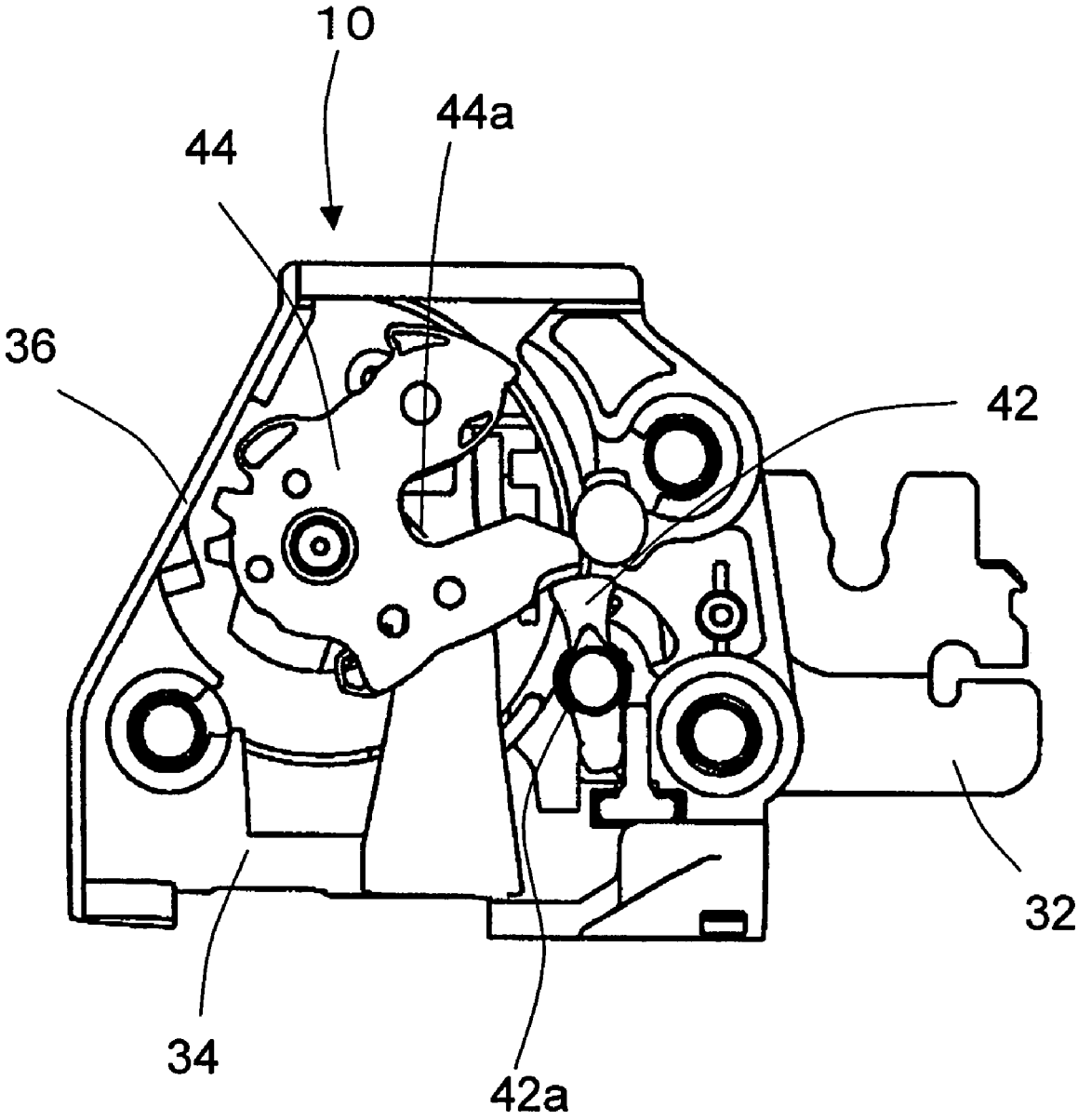
FIG. 3 is a plan view illustrating a latch mechanism of the automotive door lock device according to the embodiment.

FIG. 2 illustrates a perspective view of the entire automotive door lock device. A rear end of the housing 10 is opened by a rear end of the main casing 12 and a rear end of the first cover 14, and covered by a plate-shaped metallic sub base plate 32. Moreover, as shown in FIG. 3, this sub base plate 32 is covered by a dish-shaped resinous body base plate 34 which opens forward. A pawl spring 42*a* is placed between the sub base plate 32 and the body base plate 34, and the pawl spring 42*a* urges one end of a pawl 42 which penetrates the body base plate 34 from the rear side to the front side. The body base plate 34 is covered by a dish-shaped metallic base plate 36 which opens forward. Between the body base plate 34 and the base plate 36 there are placed the pawl 42, a ratchet 44, and a ratchet spring 44*a* which urges the ratchet 44. It is to be noted that the pawl 42 and the ratchet 44 are urged to engage each other.

FIG. 4 shows a state in which the opening of the housing 10 is open and, when this door lock device is mounted on an automobile, the left side is to be the front side of the automotive door lock device and the right side is to be the rear side of it.

As shown in FIG. 4, a swing shaft center 121 protrudes around a center of the main casing 12 of the housing 10, and the swing shaft center 121 is swing-ably engaged with a swing center 210 of the locking lever 21. The locking lever 21 is an integral body of a fan-shaped active lever 21*a* and a bar-shaped sub lever 21*b*. The locking lever 21 is provided with an operating lever connecting portion 21*c* which extends downward. A concave portion 21*d* which forms a roughly hemispherical space is formed on the operating lever connecting portion 21*c*. It is to be noted that the operating lever connecting portion 21*c* constitutes the operating lever connecting portion of the present invention and that the locking lever 21 having the operating lever connecting portion 21*c* constitutes the operating lever member of the present invention. It is also to be noted that the concave portion 21*d* constitutes the concave portion defined in the present invention.

Moreover, as shown in FIG. 5, an operation connecting portion 52*a* located at a fore end of a locking cable 52, which constitutes the operation means of the present invention, is engaged with the concave portion 21*d* of the operating lever connecting portion 21*c*. The locking cable 52 is connected to a door lock button and/or locking cylinder (not shown). The operation connecting portion 52*a* is spherical and in slidable contact with the concave portion 21*d* inside the concave portion 21*d*. Here, a tapered surface 21*e* is formed on an opening periphery of this concave portion 21*d*, and a pair of projections 21*f* is formed inside that opening periphery. It is to be noted that this operation connecting portion 52*a* constitutes the operation connecting portion of the present invention which serves as the spherical portion. It is also to be noted that the projections 21*f* constitute the projections of the present invention. Thus, the operation connecting portion 52*a* is internally held by the concave portion 21*d* which has the tapered surface 21*e* and the projections 21*f* on the opening periphery. In this way, the tapered surface 21*e* makes it easy to connect the operation connecting portion 52*a* to the concave portion 21*d*. Moreover, if the operation connecting portion 52*a* is connected to the concave portion 21*d*, the projections 21*f* make it difficult for the operation connecting portion 52*a* to drop off from the concave portion 21*d*. Therefore, a dropout of the operation connecting portion 52*a* from the concave portion 21*d* can be securely prevented.

As shown in FIG. 5, an opening portion 13 is formed on the underside of the main casing 12, which is covered by the first cover 14. A pair of thin connecting pieces 122*a* is integrally formed at a lower end of the main casing 12, and a cover body 122*b* is integrally formed with those connecting pieces 122*a*. The connecting pieces 122*a* and the cover body 122*b* constitute a cover portion integrally formed with the housing 10. It is to be noted that the first cover 14 constitutes the housing body of the present invention and that the cover body 122*b* constitutes the cover portion of the present invention. A retaining projection 123*a*, a stopper projection 123*b*, an elastic retaining hook 123*c*, a pair of elastic retaining pieces 123*d*, a flange 123*e* and a drain notch are formed on the cover body 122*b*. The retaining projection 123*a*, the stopper projection 123*b* and the elastic retaining hook 123*c* constitute the distance keeping means of the present invention. A projecting portion 122*c* having a downwardly convex arc shape and projecting perpendicularly to the plane of FIG. 5 is formed on the cover body 122*b*. Moreover, an auxiliary projecting portion 122*d* which reinforces the projecting portion 122*c* is formed along the shape of the projecting portion 122*c*. This cover body 122*b* is folded by the connecting pieces 122*a* after the operation connecting portion 52*a* is engaged with the abovementioned concave portion 21*d*, and the opening portion 13 is closed by the cover body 122*b*. It is to be noted that the projecting portion 122*c* constitutes a protruding ridge which serves as the projecting portion of the present invention.

Here, as shown in FIG. 6, the projecting portion 122*c* of the cover body 122*b* is located in front of the operation connecting portion 52*a* connected to the concave portion 21*d*, and the auxiliary projecting portion 122*d* protrudes from the projecting portion 122*c* at a position facing the concave portion 21*d*. Moreover, a convex portion 12*c* which can contact the locking lever 21 is formed inside the main casing 12 at a position facing the projecting portion 122*c* of the cover body 122*b*. It is to be noted that this convex portion 12*c* constitutes a protruding ridge which serves as the convex portion of the present invention.

Moreover, as shown in FIG. 5, the projecting portion 122*c* and the auxiliary projecting portion 122*d* have an upwardly convex arc shape, and in a state in which the opening portion 13 is closed by the cover body 122*b*, the projecting portion 122*c* and the auxiliary projecting portion 122*d* have a downwardly convex arc shape. Therefore, the projecting portion 122*c* and the auxiliary projecting portion 122*d* are located along a moving locus of the concave portion 21*d* of the operating lever connecting portion 21*c* and the operation connecting portion 52*a* of the locking cable 52. The retaining projection 123*a* of the cover body 122*b* is constructed to be engaged with the locking cable 52 and retain the cover body 122*b*. The elastic retaining hook 123*c* of the cover body 122*b* is constructed to be engaged with an elastic retaining piece 123*f* formed on the main casing 12. The pair of elastic retaining pieces 123*d* of the cover body 122*b* are constructed to be engaged with elastic retaining hooks 123*g* formed on the main casing 12.

In this way, after the concave portion 21*d* of the locking lever 21 and the operation connecting portion 52*a* of the locking cable 52 are connected to each other, the opening portion 13 of the housing 10 can be closed by the cover body 122*b* formed integrally with the main casing 12 of the housing 10. At this time, the projecting portion 122*c* of the cover body 122*b* prevents a dropout of the operation connecting portion 52*a* of the locking lever 21. Therefore, if the operation connecting portion 52*a* of the locking cable 52 is connected to the concave portion 21*d* of the locking lever 21 placed in the housing 10 and the cover body 122*b* closes the opening portion 13, the operation connecting portion 52*a* of the locking cable 52 becomes difficult to drop off from the concave portion 21*d* of the locking lever 21. Therefore, the operation connecting portion 52*a* of the locking cable 52 and the concave portion 21*d* of the locking lever 21 can be easily connected to each other only by closing the opening portion 13 of the housing 10 by the cover body 122*b*. Moreover, as shown in FIG. 6, owing to the contact of the convex portion 12*c* with the locking lever 21, the connection between the concave portion 21*d* of the locking lever 21 and the operation connecting portion 52*a* of the locking cable 52 can be sandwiched by the convex portion 12*c* and the projecting portion 122*c* of the cover body 122*b*. Therefore, the dropout of the operation connecting portion 52*a* of the locking cable 52 from the concave portion 21*d* of the locking lever 21 can be more securely prevented.

In this automotive door lock device, as shown in FIG. 4, a fore end of the sub lever 21*b* of the locking lever 21 is engaged with a long hole 24*a* formed on the open link 24. A lower end of the open link 24 is engaged with one end of the open lever 28. As shown in FIG. 4, the open lever 28 is swingably provided within the second casing portion 12*b* of the main casing 12, and the other end of the open lever 28 is engaged with an outside cable not shown, and the outside cable is connected to an outside handle (not shown) provided on the outside of a door. Moreover, the lift lever 29 is swingably provided within the second casing portion 12*b* of the main casing 12, and the pawl 42 is swingably engaged with the lift lever 29. Moreover, the lift lever 29 is swingably engaged by a flange portion 24*b* formed on the center of the open link 24.

Moreover, as shown in FIG. 4, the active lever 21*a* of the locking lever 21 can be engaged with the wheel gear 22, and the wheel gear 22 is connected to the motor M by way of the worm gear 23.

Furthermore, the swing center 210 of the locking lever 21 is engaged with a swing center of the second inside lever 25. The swing center of the second inside lever 25 is engaged with a swing center of the first inside lever 26. A slide bush 25*a* is slidably engaged with a fore end of the second inside lever 25, and the slide bush 25*a* is engaged with an engaging hole 26*a* formed at one end of the first inside lever 26. The swing center of the first inside lever 26 is engaged with a swing center of the child protector lever 27. The other end of the first inside lever 26 is engaged with an inside cable 26*b* connected to an inside handle (not shown).

Figure 7:
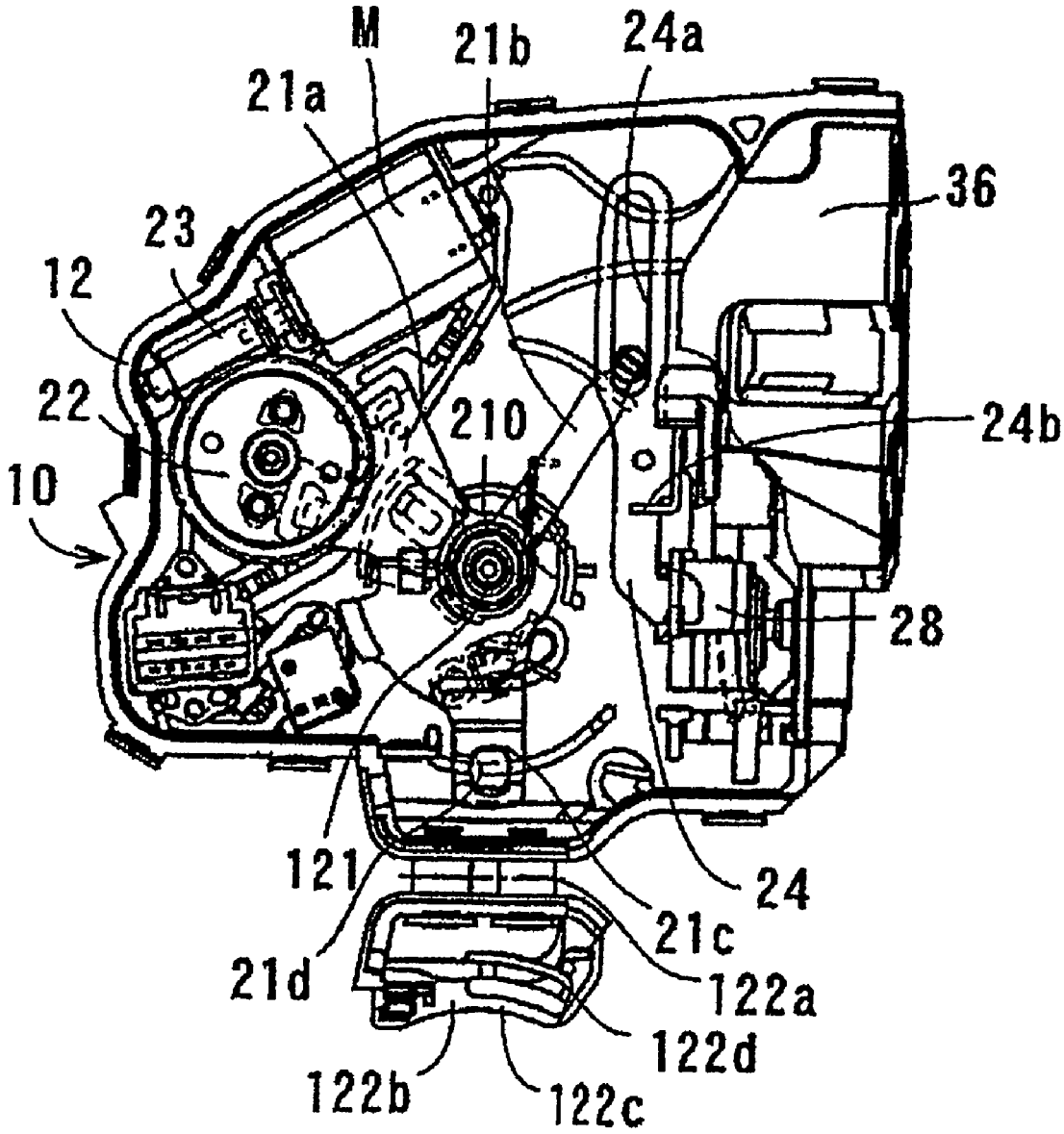
FIG. 7 is a partial front elevational view of the automotive door lock device according to the embodiment in an unlocked and unlatched state.
Figure 7:
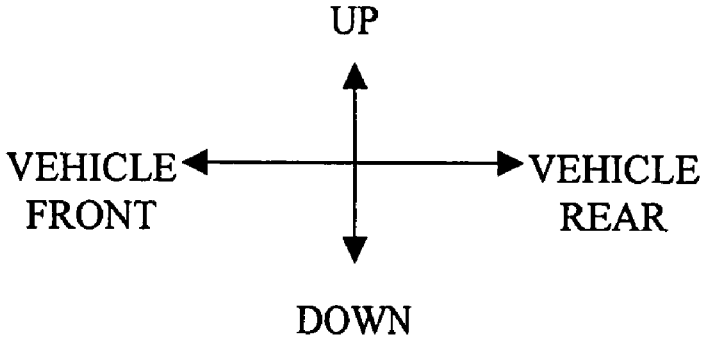

In the automotive door lock device having the above construction, upon operating the outside handle (not shown) provided outside of the door, the outside cable not shown is operated. The operation of the outside cable makes the open lever 28 engaged with the outside cable swing. Upon swinging of the open lever 28, as shown in FIG. 7, the lower end of the open link 24 is lifted and the lift lever 29 is swung by the flange portion 24*b* of the open link 24. The swing of the lift lever 29 makes the pawl 42 shown in FIG. 3 swing. The swing of the pawl 42 makes the ratchet 44 swing. The ratchet 44 is disengaged from a striker not shown and released from the engagement with the door having the striker. Thus, the door can be opened by operating the outside handle.

Moreover, upon operating the inside handle (not shown), the inside cable 26*b* is operated. The operation of the inside cable 26*b* makes the first inside lever 26 swing. The swing of the first inside lever 26 makes the second inside lever 25 swing by way of the slide bush 25*a*. The swing of the second inside lever 25 makes the flange portion 24*b* of the open link 24 lifted. Then, as shown in FIG. 7, the open link 24 is lifted with the flange portion 24*b*, and the lift lever 29 is swung by the flange portion 24*b* of the open link 24. The swing of the lift lever 29 makes the pawl 42 swing. Then, the swing of the pawl 42 makes the ratchet 44 swing. The ratchet 44 is disengaged from the striker (not shown) and released from the engagement with the door having the striker. Thus, the door can be opened by operating the inside handle.

Figure 8:
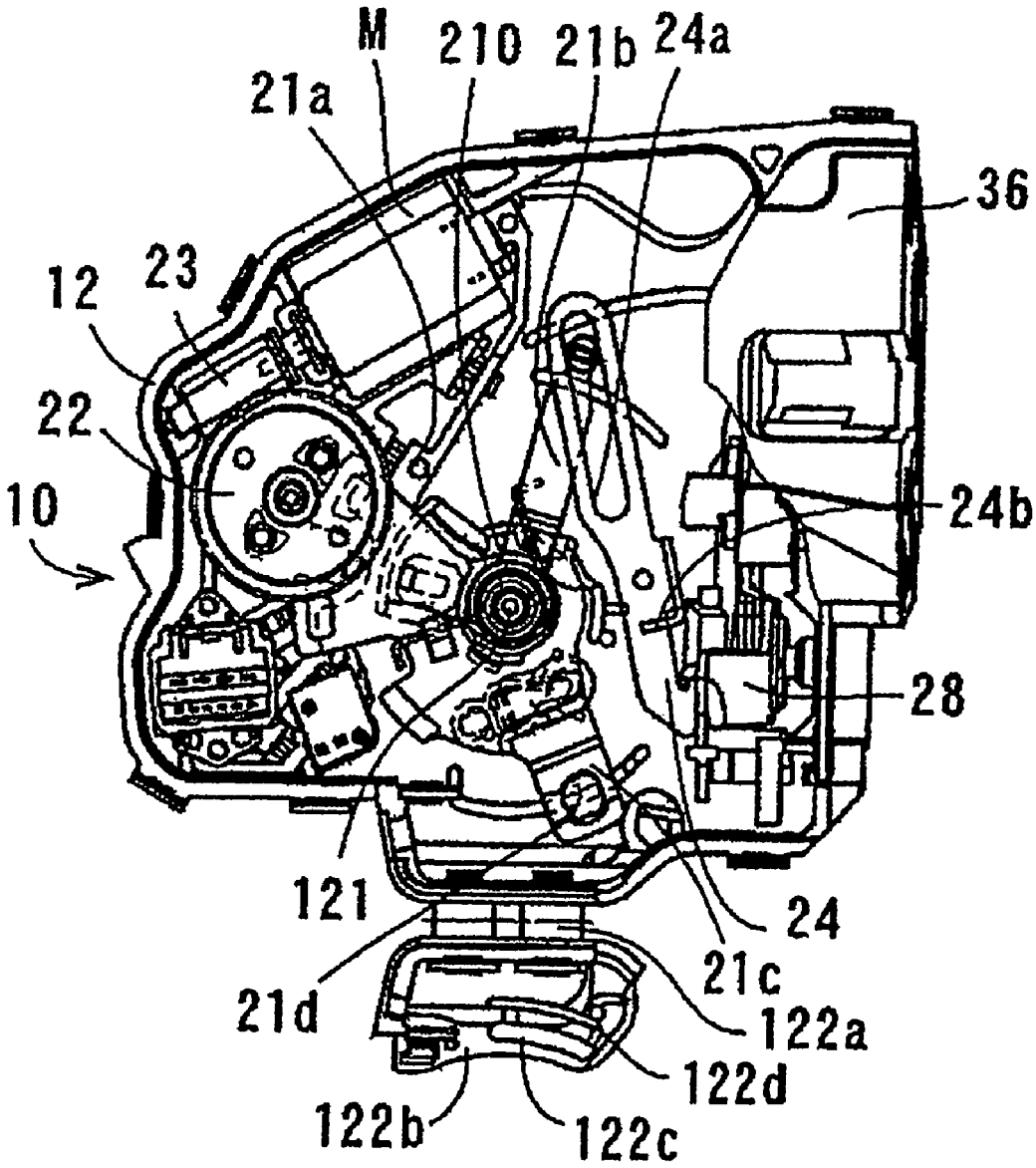
FIG. 8 is a partial front elevational view of the automotive door lock device according to the embodiment in an initial locked state.
Figure 8:
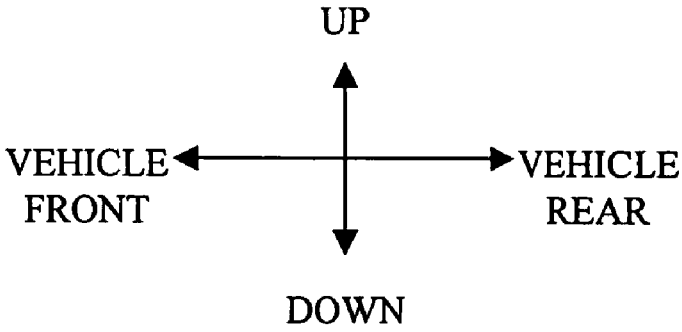
Figure 9:
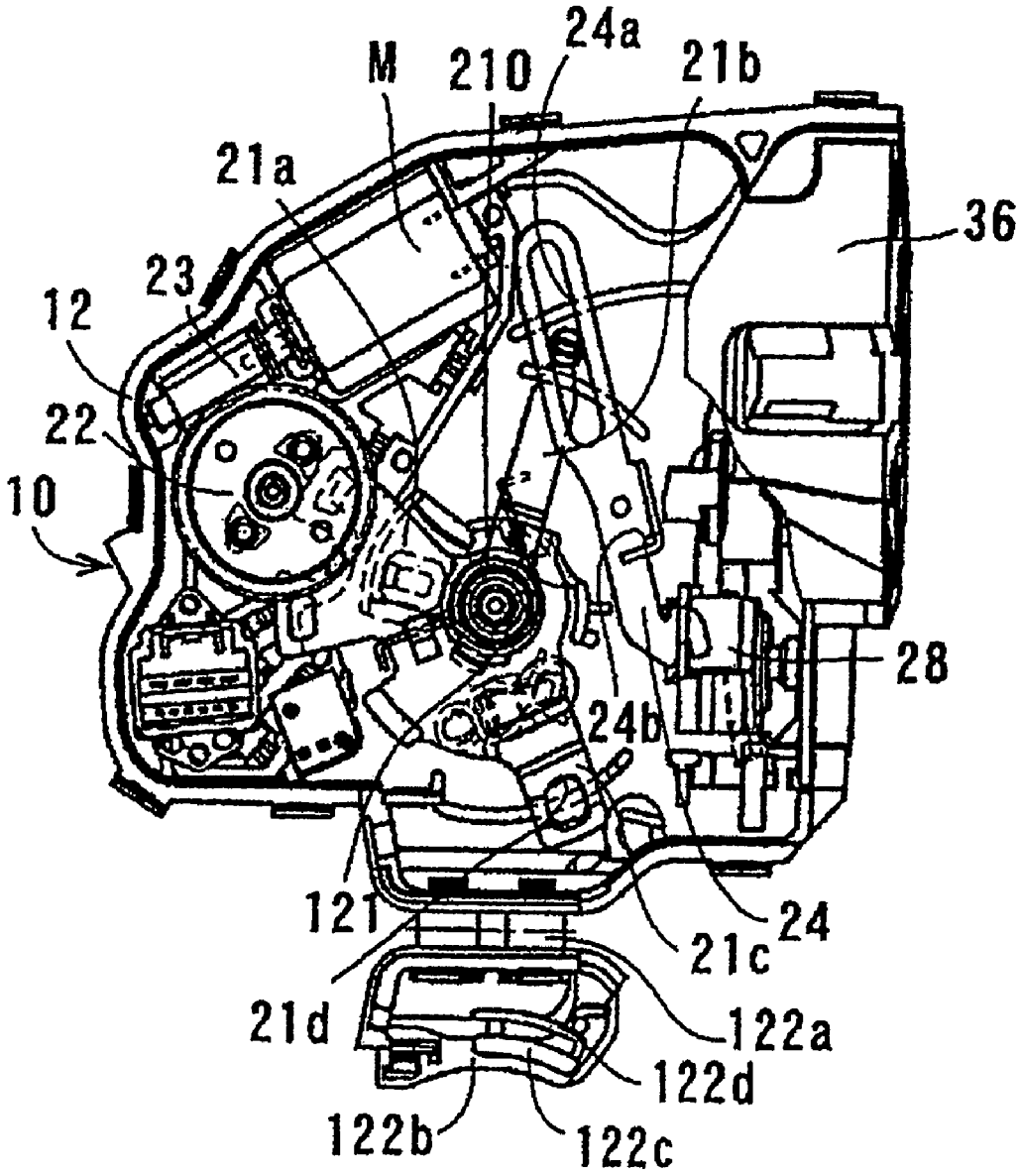
FIG. 9 is a partial front elevational view of the automotive door lock device according to the embodiment in a locked state.
Figure 9:
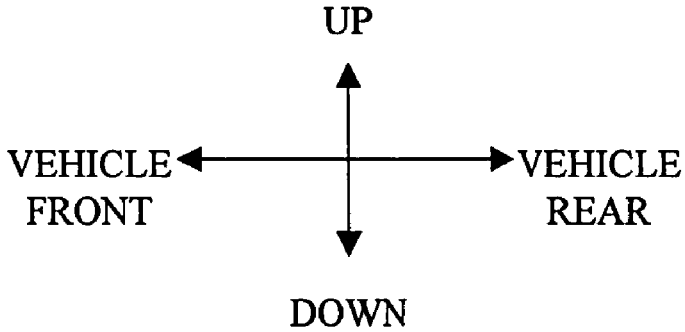

Furthermore, upon operating the locking cable 52, the concave portion 21*d* as well as the operation connecting portion 52*a* is swung. At this time, the operation connecting portion 52*a* and the concave portion 21*d* are swung in an arc-shaped moving locus along the shape of the abovementioned projecting portion 122*c* and auxiliary projecting portion 122*d* of the cover body 122*b*. Since the operation connecting portion 52*a* and the concave portion 21*d* are in slidable contact with each other, their connection is hardly broken even if the operation connecting portion 52*a* and the concave portion 21*d* swing in the arc-shaped moving locus. As shown in FIG. 8, the swing of the concave portion 21*d* makes the locking lever 21 swing in the counterclockwise direction. The swing of the locking lever 21 makes the sub lever 21*b* swing similarly. The swing of the sub lever 21*b* makes a fore end of the sub lever 21*b* move in the counterclockwise direction. The movement of the sub lever 21*b* makes the open link 24 engaged by the long hole 24*a* incline more as the sub lever 21 moves farther. Therefore, the flange portion 24*b* of the open link 24 is disengaged from the lift lever 29. Therefore, as shown in FIG. 9, even if the abovementioned outside handle or inside handle is operated, the open link 24 and the lift lever 29 do not come in engagement and accordingly the pawl 42 and the ratchet 44 shown in FIG. 3 are not swung. Thus, the door can be locked by operating the locking cable 52.

In the abovementioned embodiment, not only the locking lever 21 but also the open lever 28 and the first inside lever 26 can be used as the operating lever member. Moreover, the concave portion 21*d* which serves as the operating lever connecting portion can also be formed on the open lever 28 or the first inside lever 26. Furthermore, not only the locking cable 52 but also the inside cable 26*b* and the outside cable can be used as the operation means. Moreover, the spherical operation connecting portion 52*a* can also be formed on a fore end of the inside cable 26*b* or the outside cable.

The invention claimed is:

1. An automotive door lock device, comprising:

a housing having an opening portion and a cover portion formed integrally with the housing for covering and closing the opening portion;

a latch mechanism configured to be moved between a position in which a door is in closed state and a position in which the door is in an opened state;

opening means configured to operate the latch mechanism;

locking means to prevent the opening means from operating the latch mechanism, the locking means including an operating lever member placed in the housing and having an operating lever connecting portion; and operation means having an operation connecting portion to be connected to be the operating lever connecting portion, wherein the cover portion of the housing has an arc-shaped projecting portion inhibiting separation of the operation connecting portion and the operating lever connecting portion in a direction away from each other, and the projecting portion is located along an arc-shaped moving locus of the operation connecting portion and operating lever connecting portion.

2. The automotive door lock device recited in claim 1, wherein a convex portion capable of contacting the operating lever member is formed on the housing at a position facing the projecting portion of the cover portion in a closed state.

3. The automotive door lock device recited in claim 2, wherein the convex portion inhibits separation of the operating lever connecting portion from the operation connecting portion.

4. The automotive door lock device recited in claim 1, wherein either one of the operating lever connecting portion and the operation connecting portion is constituted by a concave portion, and the other one of the operating lever connecting portion and the operation connecting portion is a spherical portion to be attached and connected to the concave portion.

5. The automotive door lock device recited in claim 4, wherein the operating lever connecting portion is the concave portion and the operation connecting portion is the spherical portion held slidably by the concave portion.

6. The automotive door lock device recited in claim 4, wherein a tapered surface is formed on an opening periphery of the concave portion and a projection is formed inside the opening periphery.

7. The automotive door lock device recited in claim 4, wherein an opening of the concave portion faces the opening portion of the housing.

8. The automotive door lock device recited in claim 4, wherein space sectioned by the concave portion is hemispherical.

9. The automotive door lock device recited in claim 1, wherein the housing comprises a housing body and a main casing, and wherein the housing body and the cover portion have distance keeping means for keeping the distance between the housing body and the cover portion constant when the cover portion is in a closed state.

* * * * *